US006328228B1

(12) United States Patent
Bossini

(10) Patent No.: US 6,328,228 B1
(45) Date of Patent: Dec. 11, 2001

(54) SHOWER WITH NOZZLES FOR THE DELIVERY OF ATOMIZED JETS OF WATER

(75) Inventor: Leonardo Bossini, Molinetto di Mazzano (IT)

(73) Assignee: Bossini S.R.L. (IT)

( * ) Notice: Subject to any disclaimer, the term of this patent is extended or adjusted under 35 U.S.C. 154(b) by 0 days.

(21) Appl. No.: 09/479,689

(22) Filed: Jan. 7, 2000

(30) Foreign Application Priority Data

Mar. 19, 1999 (IT) ..... BS99U0023

(51) Int. Cl.[7] ..... A62C 31/02

(52) U.S. Cl. ..... 239/390; 239/391; 239/440; 239/445; 239/447; 239/436

(58) Field of Search ..... 239/380, 381, 239/382, 390, 391, 443–447, 492, 493, 436, 437, 440, 441, 451, 548, 392

(56) References Cited

U.S. PATENT DOCUMENTS

| | | | | |
|---|---|---|---|---|
| 4,131,233 | * | 12/1978 | Koening | 239/447 |
| 4,303,201 | * | 12/1981 | Elkins et al. | 239/391 |
| 4,618,100 | * | 10/1986 | White et al. | 239/447 |
| 4,703,893 | * | 11/1987 | Gruber | 239/391 |
| 5,213,267 | * | 5/1993 | Heimann et al. | 239/446 |

* cited by examiner

*Primary Examiner*—David A. Scherbel
*Assistant Examiner*—Dinh Q. Nguyen
(74) *Attorney, Agent, or Firm*—McGlew and Tuttle, P.C.

(57) ABSTRACT

The invention concerns a shower for the delivery of differentiated jets of water characterised by the fact that it incorporates injector means (35) to generate and deliver atomized jets of water through a crown of atomizer nozzles (27) governed by a rotating distribution element.

8 Claims, 4 Drawing Sheets

SHOWER WITH NOZZLES FOR THE DELIVERY OF ATOMIZED JETS OF WATER

FIELD OF THE INVENTION

This invention concerns showers for the delivery of differentiated jets of water.

BACKGROUND OF THE INVENTION

Already available on the market are those showers with a head housing concentric elements assembled as a unit and which form a combination of one, two or more types of passage for the delivery of the same number of different jets of water, and where at least one of the elements can be rotated by hand to distribute the incoming water through at least one feed hole and selectively through each type of passage depending on the shape of the required jet of water.

Such showers are usually pre-set for the delivery of different types of jets of water, such as, fine, delicate (soft), pulsating or massaging, etc, and the methods used to move from one type of jet to another are known.

SUMMARY AND OBJECTS OF THE INVENTION

The foremost aim of this invention is to produce and supply a shower capable of delivering atomised jets of water besides the other common types of jets of water.

Another aim of this invention is to propose a shower with incorporated injector-diffuser units having a particular configuration and combination to generate and deliver atomised water through a crown of nozzles with the advantage of having water finely subdivided for various uses that is not possible to achieve with the more traditional showers.

The aims of the present invention are accomplished with the shower having a housing defining an opening for receiving liquid, such as water. The plurality of different types of nozzles are in the housing, where one of the types of nozzles are atomizer type nozzles. The atomizer type nozzles are ranged in a crown pattern in the housing. A control element is also positioned in the housing and selectively communicates passages between the opening in the housing and the plurality of different types of nozzles.

DESCRIPTION OF THE PREFERRED EMBODIMENT

Figure 1:
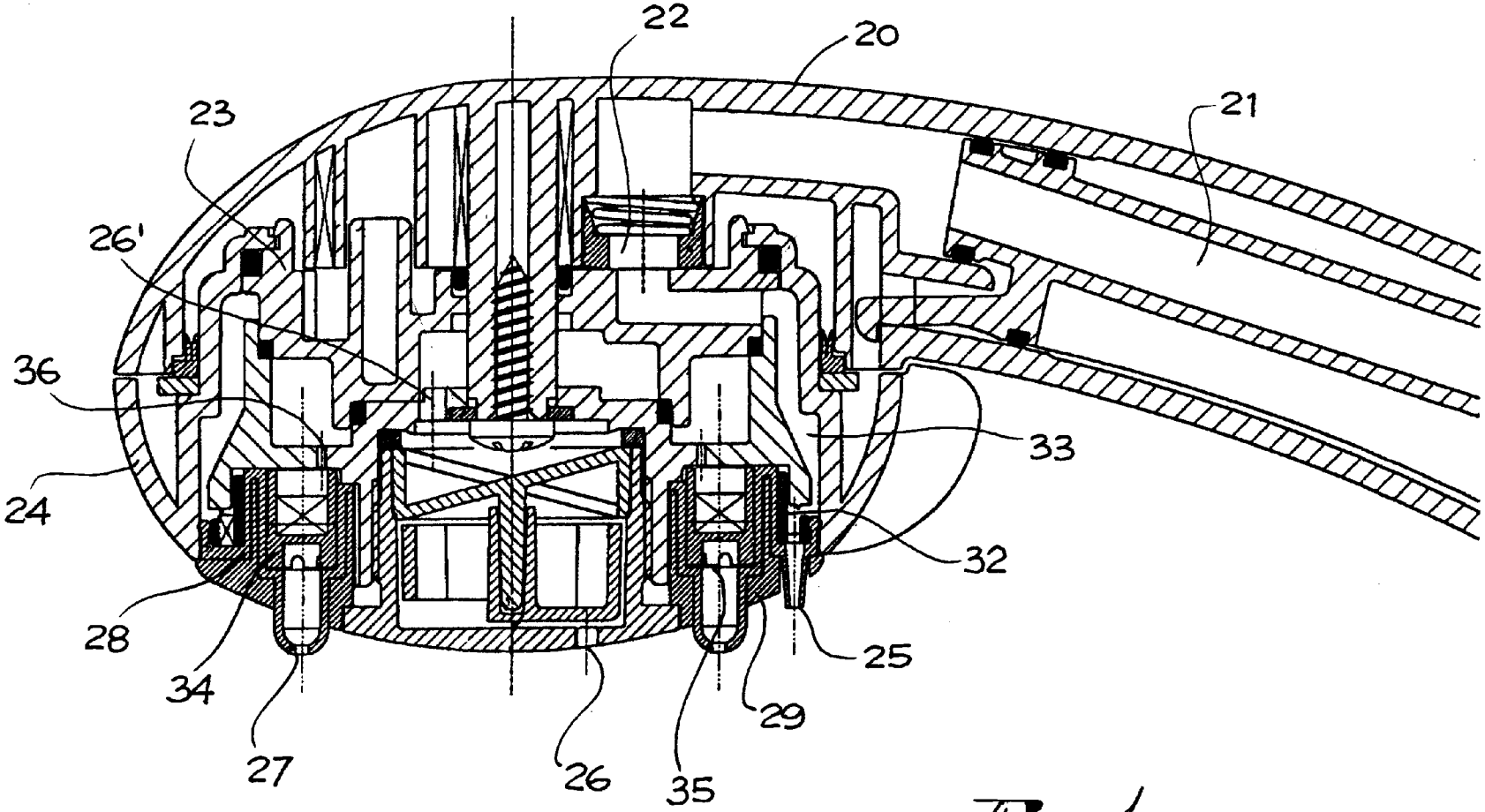
FIG. 1 shows a cross-section of the shower assembly.

The shower shown is composed of a body a housing 20 having a longitudinal duct or opening 21 connected to a water inlet pipe—not indicated—having an outlet 22 towards well known elements not requiring definitions, whose purpose is to control the water delivery according to the different jets.

In the example shown, such elements include a multiple-way conveyor-distributor 23 equipped with a control knob 24 capable of selectively deviating the water from the incoming duct 22 to a first series of external nozzles 25 for the delivery of fine jets of water, to a diffuser with nozzles 26 for delivery of pulsating or massaging jets of water, and to a crown of atomizer nozzles 27 for the delivery of the water in future different shapes or forms.

According to this Invention this crown of nozzles 27 is aimed at delivering for the most part atomised water.

Figure 5:
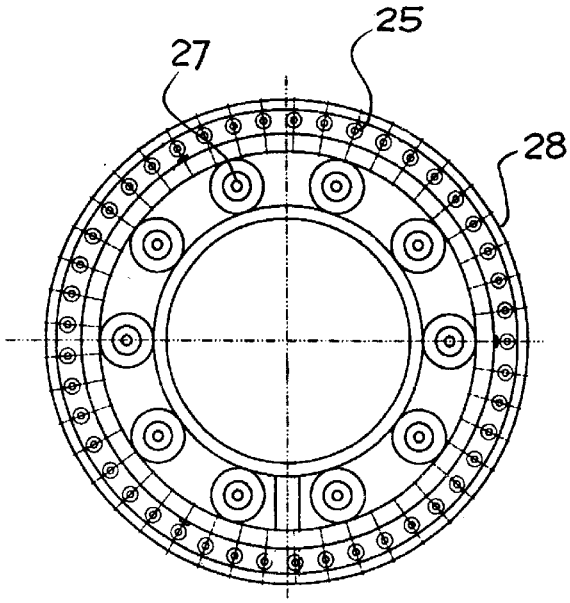
FIGS. 5, 6 and 7 show, respectively, the views of a diffuser with nozzles.
Figure 10:
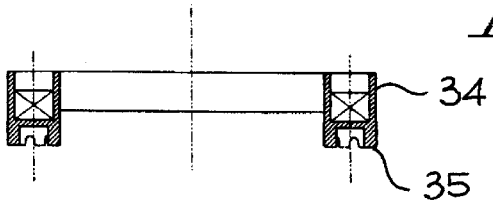
FIGS. 8, 9 and 10 show similar views of an injector.
Figure 7:
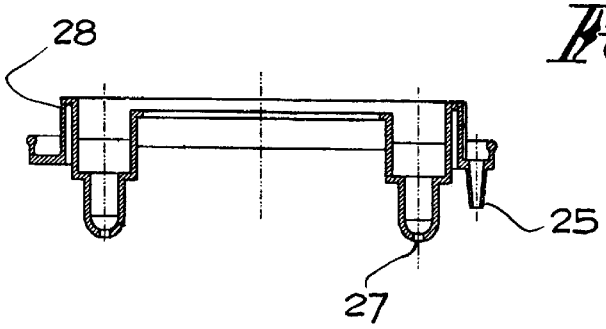
Figure 6:
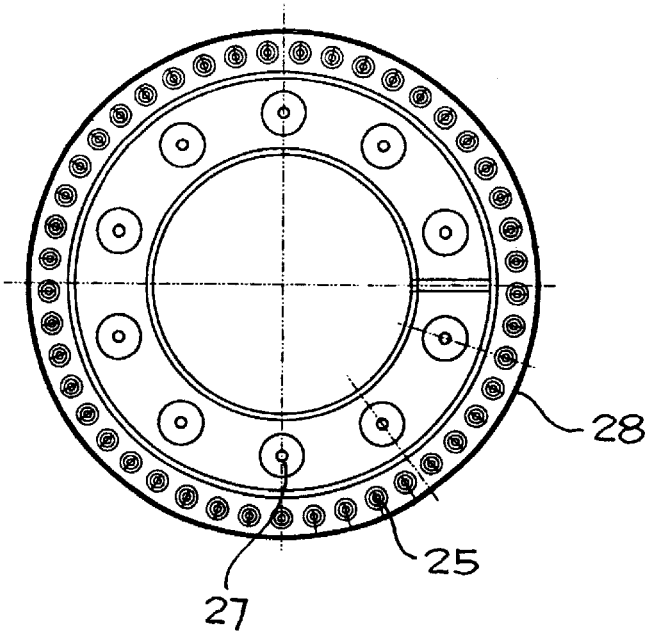
Figure 8:
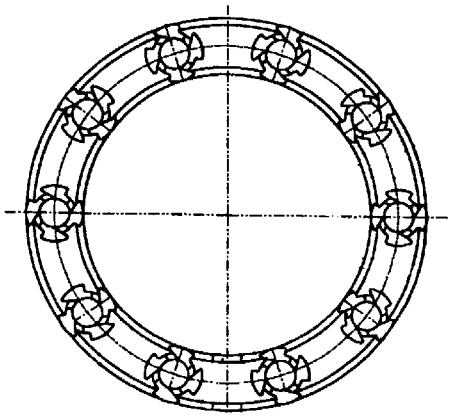
Figure 9:
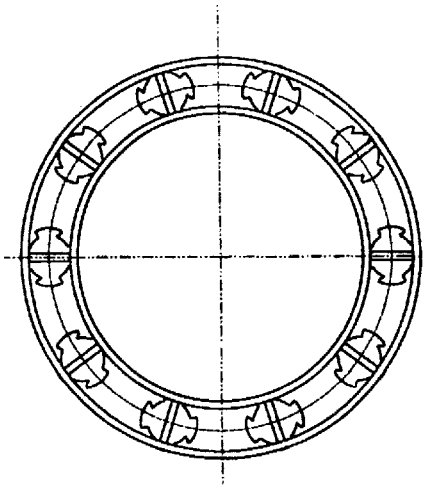

Such atomizer nozzles 27 have the form of teats in a ring-shaped diffuser 28, preferably a rubber one, together with the first series of nozzles 25, in the form of teats—FIGS. 5–7.

Figure 2:
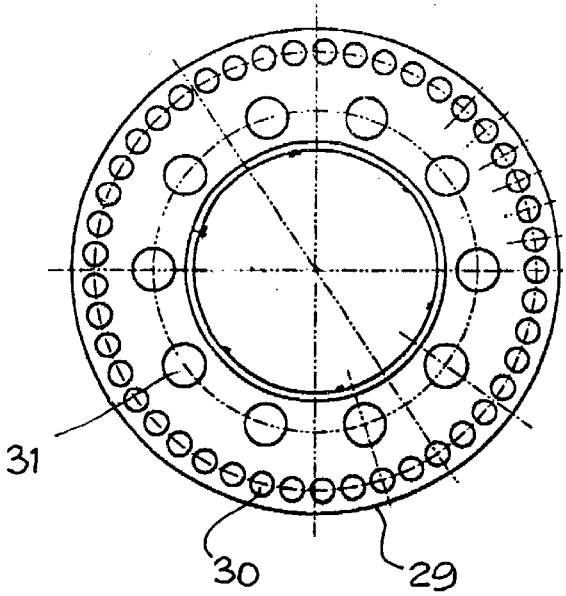
FIGS. 2, 3 and 4 show, respectively, the external, internal and cross-section of a diffuser-holder flange.
Figure 3:
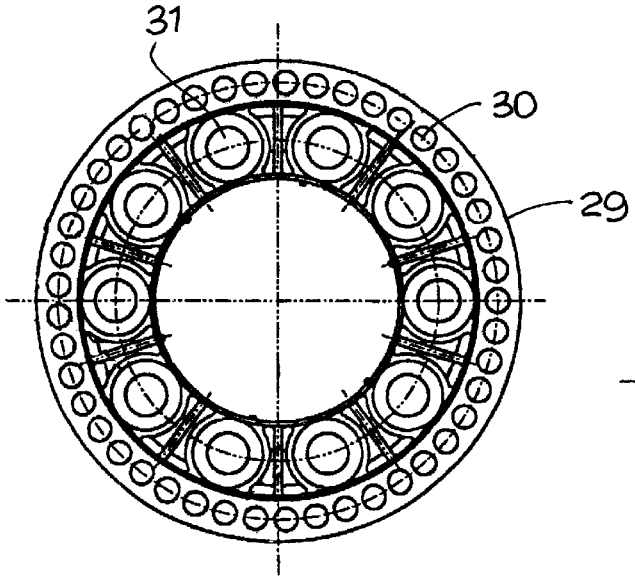
Figure 4:
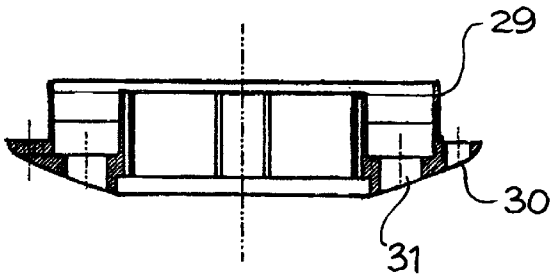

The ring shaped diffuser 28 is held and coupled with a rigid flange 29 presenting a series of holes 30 for the first order of nozzles 25 and a second series of holes or atomizer nozzles holes 31 for the crown of atomizer nozzles 27, FIGS. 2–4.

Another diffuser with nozzles 26 for the massaging jets of water is positioned in the centre of the flange 29—FIG. 1—and receives water from a analogous duct 26 controlled by the distributor.

A ring 32 with water ducts, coinciding with the first order of nozzles 25 is located around the flange 29. The water reaches these nozzles by flowing through a duct 33 governed by the distributor 23.

A rigid injector ring 34, which holds several atomizer injectors 35 has been inserted in the ring-shaped diffuser 28, each positioned in correspondence with one of the nozzles In the crown of nozzles 27. The injector ring 34, the diffuser ring 28, the flange 29 and the distributor 23 are substantially concentric.

The injectors 35 receive water through the holes or injector passages 36 that can be opened and closed as often as one wishes, governed by the distributor 23 when the form of the jet of water to be delivered is selected.

Figure 11:
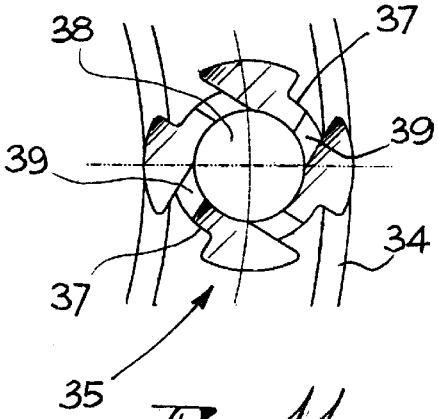
FIGS. 11 and 12 show two detailed views of the injector in FIG. 8.
Figure 12:
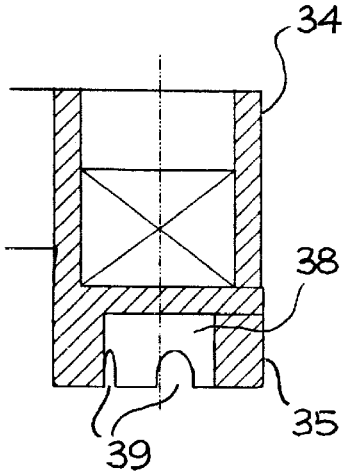

Each injector 35 is made up principally of a cylindrical element projecting from the injector ring 34 towards the inner chamber of its corresponding nozzle 27. The projecting element—FIGS. 8–12—presents longitudinal lateral channels 37, each of them in communication with a central chamber 38 provided at the base of the element and open towards the atomiser nozzle 27. More precisely, each longitudinal lateral channel 37 is connected to this central chamber through a non-radial passage 39, but orientated at a tangent to the cavity itself—FIG. 11—.

In this way, when the distributor 23 is in the position to send water to the injectors 35, the water is obliged to pass through the lateral channels 37 of each injector and compelled to enter its lower central chamber 38 through the tangential passages 39. Thanks to the location of these passages water will whirl into the chamber 39 increasing its speed and pressure and creating, however, the conditions to deliver the water in a fine atomised form from the corresponding nozzles 27. The overall effect of the atomised water Is particularly appreciated and useful for various uses in the care of hair and skin.

While specific embodiments of the invention have been shown and described in detail to illustrate the application of the principles of the invention, it will be understood that the invention may be embodied otherwise without departing from such principles.

What is claimed is:

1. A shower comprising:

a housing having an opening for receiving liquid;

a plurality of different types of nozzles in said housing, one of said types of nozzles including a plurality of atomizer nozzles, said plurality of atomizer nozzles being formed in a diffuser ring arranged in a crown pattern, said diffuser ring by arranged in said housing;

a flange arranged in said housing, said flange declining a plurality of atomizer nozzle holes for receiving sad atomizer nozzles in said crown pattern;

an injector ring arranged in said housing and forming a plurality of atomizer injectors, said atomizer injectors being received in said atomizer nozzles of said diffuser ring;

a distributor positioned in said housing and selectively communicating passages between said opening in sad housing and said plurality of different types of nozzles.

2. A shower in accordance with claim 1, wherein:

each of said plurality of atomizer injectors define a central chamber and a plurality of channels outside of said central chamber, said each atomizer injector also defining a plurality of tangential passages connecting said plurality of channels to said central chamber, said tangential passages directing liquid from said channels to cause the liquid to leave from said atomizer nozzles in an atomized form.

3. A shower in accordance with claim 2, wherein:

said each atomize injector is substantially cylindrical and said central chambers define a base opening arranged toward a respective said atomizer nozzle.

4. A shower in accordance with claim 1, wherein:

said distributor, said diffuser ring, said flange and said injecting ire substantially concentric in said housing.

5. A shower in accordance with claim 1, wherein:

said atomizer injectors project from said injector ring and are inserted with force into the atomizer nozzles, said atomizer injectors receive the liquid through injector passages in said distributor which correspond to said injector ring.

6. A shower in accordance with claim 1, wherein:

said differ ring with said atomizer nozzles is formed of rubber, said diffuser ring also includes a plurality of another type of nozzles for delivering the liquid in another form different from said atomizer nozzles.

7. A shower in accordance with claim 6, wherein:

said flange is rigid;

said diffuser ring is coupled to said flange;

said injector ring is force fitted to said distributor to cause said atomizer injectors to be inserted into said atomizer nozzles.

8. A shower in accordance with claim 1, wherein:

said flange is rigid;

said diffuser ring is coupled to said flange;

said injector ring is force fitted to said distributor to cause said atomizer injectors to be inserted into said atomizer nozzles.

* * * * *